US005708228A

United States Patent [19]

Sutula, Jr. et al.

[11] Patent Number: 5,708,228

[45] Date of Patent: Jan. 13, 1998

[54] METHOD AND APPARATUS FOR TRANSFER OF INITIATION SIGNALS

[75] Inventors: Daniel P. Sutula, Jr., Farmington; Ronald M. Dufrane, North Granby; Thomas F. Lilley, Simsbury; Thomas C. Tseka, West Suffield; Steven L. Renfro, Granby; Jeffrey H. Burton, Windsor Locks; Ernest L. Gladden, Granby; Daniel A. Toro, Waterbury, all of Conn.

[73] Assignee: The Ensign-Bickford Company, Simsbury, Conn.

[21] Appl. No.: 548,813

[22] Filed: Jan. 11, 1996

[51] Int. Cl.[6] ..... C06C 5/00; F42B 3/00

[52] U.S. Cl. ..... 102/275.7; 102/275.5; 102/275.6; 102/275.11; 102/275.12; 102/318

[58] Field of Search ..... 102/275.1, 275.2, 102/275.3, 275.4, 275.5, 275.6, 275.7, 275.8, 275.9, 275.11, 275.12, 318

[56] References Cited

U.S. PATENT DOCUMENTS

| | | | |
|---|---|---|---|
| Re. 30,621 | 5/1981 | Calder, Jr. et al. | 102/275.3 |
| Re. 31,953 | 7/1985 | Calder, Jr. et al. | 102/318 |
| 1,968,565 | 7/1934 | Mallet | 102/275.7 |
| 2,715,365 | 8/1955 | Godchaux, II et al. | 102/275.3 |
| 2,923,239 | 2/1960 | Andrew et al. | 102/275.4 |
| 2,952,206 | 9/1960 | Becksted | 102/275.7 |
| 3,095,812 | 7/1963 | Coursen | 102/275.2 |
| 3,175,491 | 3/1965 | Robertson | 102/275.7 |
| 3,669,021 | 6/1972 | Spencer et al. | 102/275.2 |
| 3,878,785 | 4/1975 | Lundborg | 102/275.4 |
| 3,987,733 | 10/1976 | Spraggs et al. | 102/275.3 |
| 4,141,296 | 2/1979 | Calder, Jr. et al. | 102/275.3 |
| 4,166,418 | 9/1979 | Calder, Jr. | 102/275.3 |
| 4,167,139 | 9/1979 | Gleason et al. | 102/275.3 |
| 4,187,780 | 2/1980 | Petruccelli | 102/275.12 |
| 4,248,152 | 2/1981 | Yunan | 102/275.4 |
| 4,295,424 | 10/1981 | Smith et al. | 102/275.4 |
| 4,299,167 | 11/1981 | Bryan | 102/202.3 |
| 4,335,652 | 6/1982 | Bryan | 102/275.3 |
| 4,350,097 | 9/1982 | Bowman et al. | 102/275.2 |
| 4,424,747 | 1/1984 | Yunan | 102/275.2 |
| 4,426,933 | 1/1984 | Yunan | 102/275.3 |
| 4,481,884 | 11/1984 | Yunan | 102/275.4 |
| 4,485,741 | 12/1984 | Moore et al. | 102/275.7 |
| 4,495,867 | 1/1985 | Mitchell, Jr. et al. | 102/275.4 |
| 4,527,482 | 7/1985 | Hynes | 102/275.2 |
| 4,637,312 | 1/1987 | Adams et al. | 102/275.3 |

(List continued on next page.)

FOREIGN PATENT DOCUMENTS

| | | | |
|---|---|---|---|
| 1203121 | of 0000 | Canada . | |
| 668932 | of 0000 | U.S.S.R. | 102/275.7 |
| 2097516 | 11/1982 | United Kingdom . | |
| 2228785 | 9/1990 | United Kingdom . | |

*Primary Examiner*—Michael J. Carone
*Assistant Examiner*—Theresa M. Wesson
*Attorney, Agent, or Firm*—Law Office of Victor E. Libert; Victor E. Libert; Frederick A. Spaeth

[57] ABSTRACT

A method and apparatus for transferring non-electric blasting initiation signals from detonating cord signal donor lines to signal transmission tube acceptor lines involves disposing the acceptor line in enhanced signal transfer configuration with the donor line. The acceptor line (30) may constitute the input lead (29*a*) of a detonator (10*a*). Enhanced signal transfer configuration between the input lead (29*a*) and the detonating cord (60) can be established by disposing input line (30) in at least partial wrap-around contact with the detonating cord (60) or in multiple abutting contact with the detonating cord (60). Enhanced signal transfer configuration can also be achieved for a detonator having at least two input lines in abutting contact with the detonating cord. A slider (44) is designed to extend contact between a detonator input lead and a detonating cord. The slider (44) provides a detonator retainer (48) for holding a detonator (10*a*) and a base fixture (74') that includes a pass-through aperture (58*a*) for a detonating cord (62). Input lead-retaining means (52) on the base fixture (74') disposes the input lead (29*a*) in position for enhanced signal transfer configuration with a detonating cord that may extend through the pass-through aperture (58*a*).

22 Claims, 7 Drawing Sheets

U.S. PATENT DOCUMENTS

| | | | |
|---|---|---|---|
| 4,714,017 | 12/1987 | Kelly et al. | 102/275.3 |
| 4,714,018 | 12/1987 | Lofgren | 102/275.7 |
| 4,716,831 | 1/1988 | Bartholomew et al. | 102/275.3 |
| 4,718,345 | 1/1988 | Yunan | 102/275.3 |
| 4,722,279 | 2/1988 | Yunan | 102/275.4 |
| 4,730,560 | 3/1988 | Bartholomew et al. | 102/275.3 |
| 4,776,276 | 10/1988 | Yunan | 102/275.5 |
| 4,796,533 | 1/1989 | Yunan | 102/275.3 |
| 4,799,428 | 1/1989 | Yunan | 102/275.3 |
| 4,815,382 | 3/1989 | Yunan | 102/275.7 |
| 4,821,645 | 4/1989 | Reiss | 102/275.7 |
| 5,162,606 | 11/1992 | Jacob | 102/275.5 |
| 5,171,935 | 12/1992 | Michna et al. | 102/275.7 |
| 5,173,569 | 12/1992 | Pallanck et al. | 102/210 |
| 5,204,492 | 4/1993 | Jacob et al. | 102/275.7 |
| 5,377,592 | 1/1995 | Rode et al. | 102/210 |

FIG. 6A
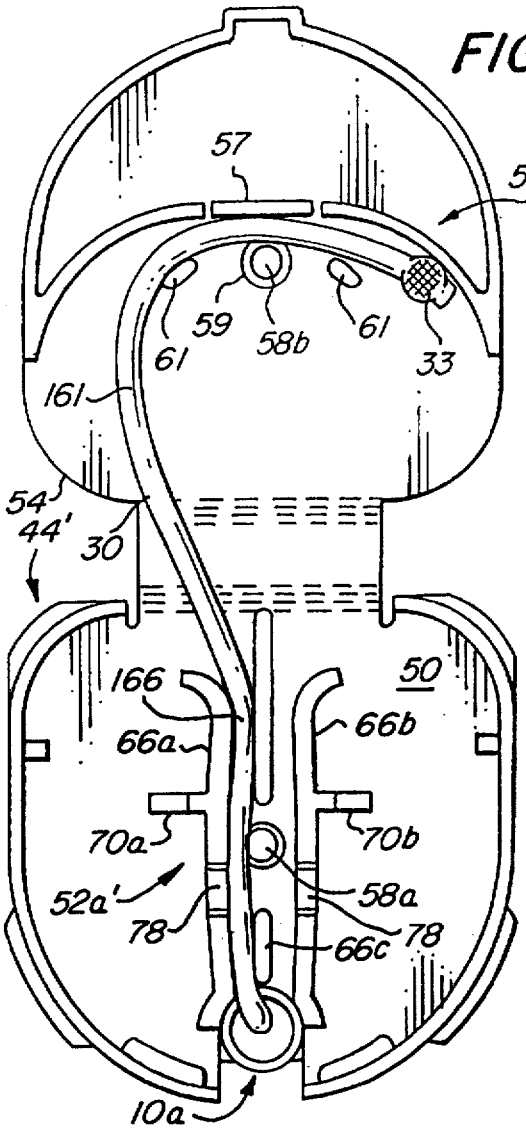
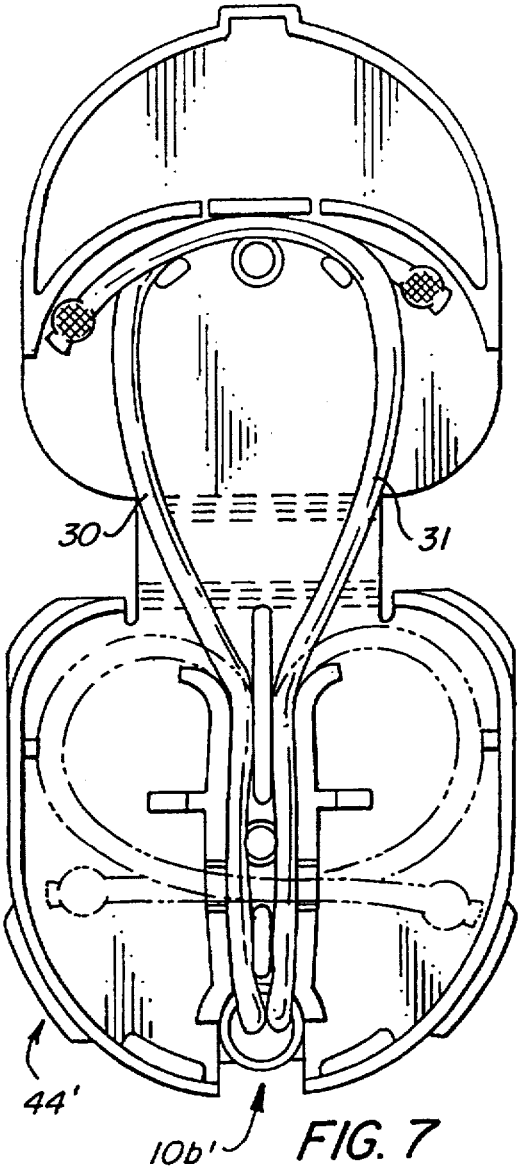
FIG. 7
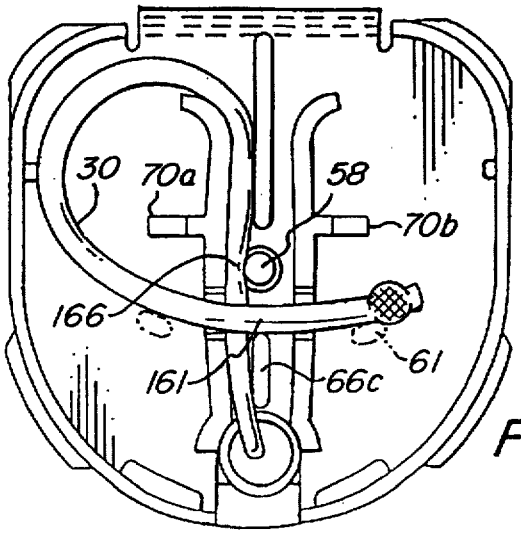
FIG. 6B

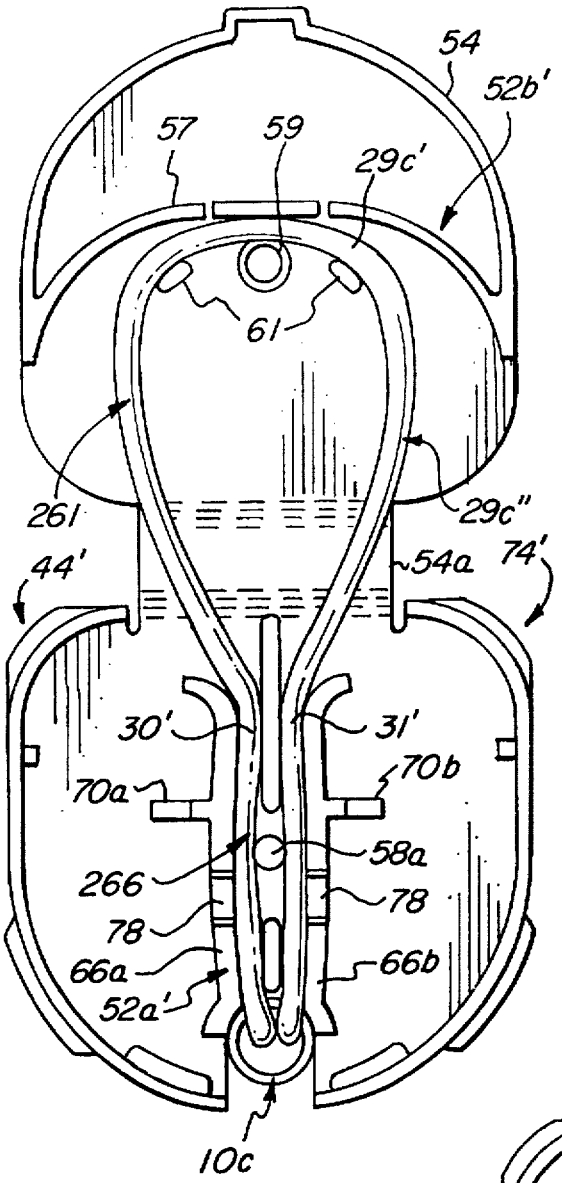
FIG. 8A
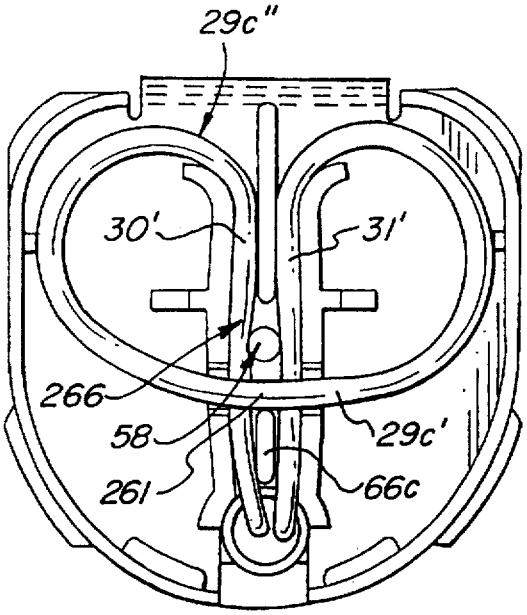
FIG. 8B
FIG. 8C
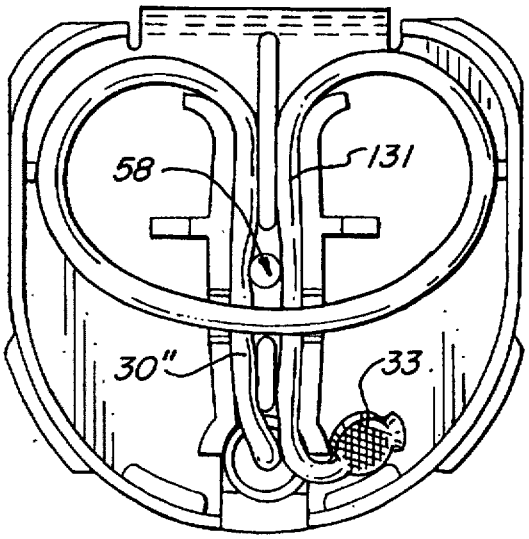

METHOD AND APPARATUS FOR TRANSFER OF INITIATION SIGNALS

BACKGROUND OF THE INVENTION

1. Field of the Invention

This invention relates to the transfer of initiation signals from detonating cord to one or more signal-receiving lines and, in particular, to the transfer of initiation signals from detonating cord to the input lead of a detonator.

2. Related Art

Detonating cord is used widely in a variety of blasting applications to carry a non-electric initiation signal from an initiation device to a signal-receiving device. For example, detonating cord is used to initiate a detonator within a booster for borehole blasting applications. The detonator not only amplifies the initiation signal from the detonating cord to initiate the booster but usually is a delay detonator which provides a preselected delay period between transfer of the signal from the detonating cord to the detonator and initiation of the booster. Such detonators are disposed within a recess in the booster with the input lead of the detonator in contact with the detonating cord. The input lead of the detonator may comprise low energy detonating cord, shock tube or low velocity signal tube, all of which are well-known in the art.

U.S. Pat. No. 4,796,533 to Yunan, dated Jan. 10, 1989, discloses a primer assembly for a cast booster having a percussion cap-actuated detonator seated therein. A length of low energy detonating cord passes through the booster in parallel relation to the detonator. An initiation signal conveyed by the detonating cord is transferred to the detonator by an explosive coupling element that comprises a shock-sensitive detonating explosive, e.g., lead azide.

U.S. Pat. No. Re. 30,621 of U.S. Pat. No. 4,141,296 to Calder, Jr. et al, reissued May 26, 1981, discloses a booster assembly in which a carrier device is employed to slidably carry a booster alongside a detonating cord downline. In accordance with the teachings of this invention, the carrier serves to separate the downline from the booster charge, to prevent direct initiation of the booster charge by the downline. As shown in FIGS. 1 and 4 and described at column 7, line 33 through column 8, line 4, the assembly comprises a detonator (160) disposed in the booster. An initiation signal is transferred from the downline (10) to the detonator (160) by a transfer line having two ends, one of which is secured in the detonator and the other of which is disposed in external structures (70), (76), (80), (94), (96) et al which hold the line in a circuitous manner around the booster and the carrier and into a partial loop about the downline. The loop is not retained in a fixture to hold it in place where it contacts the downline, i.e., it is free-standing. Since the booster is mounted alongside the downline, it is subject to canting which can impose excessively firm contact between the loop of the input lead line (134) and the downline (10), causing the loop to catch on the downline as shown in FIG. 10 of this application, thus preventing proper placement of the booster in the borehole.

U.S. Pat. No. 4,295,424 to Smith et al, dated Oct. 20, 1981, discloses a primer assembly for a borehole charge. The assembly comprises a booster charge within which a detonator is disposed. A detonating cord downline passes along the periphery of the booster at a point diametrically opposite the detonator. An initiation signal is transferred from the downline to the detonator by a detonator input lead comprising intermediary initiating means (36), FIG. 5, which contains an explosive charge and which is positioned adjacent to the downline detonating cord, and an empty hollow tubular radiator (38) extending between the initiating means (36) and the detonator.

SUMMARY OF THE INVENTION

One broad aspect of the present invention relates to a slider device for positioning in a booster a detonator having an input lead with the input lead in enhanced signal transfer configuration with a downline detonating cord. The slider device comprises a base fixture having a pass-through aperture for receiving and retaining such a downline detonating cord therein. An input lead-retaining means is carried on the device for disposing an input lead of such a detonator in position for enhanced signal transfer configuration with a detonating cord that may extend through the pass-through aperture.

In a more specific aspect, the input lead-retaining means may be dimensioned and configured to position such an input lead for at least partial wrap-around contact with a detonating cord that may extend through the pass-through aperture. Alternatively, the input lead-retaining means may be dimensioned and configured to position such input lead for multiple abutting contact with such a detonating cord. An optional detonator retainer on the device receives and retains such a detonator therein.

According to another aspect of the invention, the base fixture may comprise a base plate, a cover and hinge means for hingedly joining the cover to the base plate. The cover may then be moved between an open position and a closed position. In the open position, the input lead-retaining means is exposed to permit manipulation of an input lead into engagement with the input lead-retaining means. In the closed position, the base plate and cover cooperate to define a base chamber within which the input lead-retaining means is located. Optionally, the input lead-retaining means may comprise a first component carried on the base plate and a second component carried on the cover. In a particular embodiment, the second component of the input lead-retaining means may be dimensioned and configured to dispose a first portion of such input lead in transverse relation to a second portion of the input lead engaged by the first component of the input lead-retaining means.

The invention also relates to an initiator unit comprising a slider device as described above in combination with the detonator comprising an input lead. The input lead is disposed in the input lead-retaining means to position the input lead for enhanced signal transfer configuration with a detonating cord that may extend through the pass-through aperture of the slider device.

In a particular embodiment, the input lead may comprise at least one strand input line. Alternatively, the input lead may comprise at least one looped input line segment having a middle portion and two end portions each providing an input line for the detonator. (Such an input lead is sometimes referred to herein and in the claims as an "eyelet lead".) The input lead-retaining means may dispose an eyelet lead in position to provide abutting contact with a detonating cord extending through the pass-through aperture. In yet another alternative embodiment, the input lead-retaining means may dispose the eyelet lead about the pass-through aperture so that such detonating cord passes through the eyelet lead.

An input lead may comprise at least two strand input lines, and the input lead-retaining means on the base plate may dispose first portions of the input lines in generally parallel relation to each other and in position for abutting contact with a detonating cord extending through the pass-through aperture. Optionally, the input lead-retaining means disposes second portions of the strand input lines in position to provide abutting contact with such detonating cord and in crosswise relation to the first portions.

In a specific embodiment of the invention, the input lead-retaining means may be dimensioned and configured to dispose consecutive sections of an input lead in position to attain abutting contact with a detonating cord extending through the pass-through aperture as follows. A first section having one end secured in the detonator may be disposed to establish a first point of abutting contact with such detonating cord. A second section may form a first loop and pass transversely over and beyond the first section to establish a second point of abutting contact with such detonating cord. A third section may form a second loop and may pass transversely to and beyond the second section to establish a third point of abutting contact with such detonating cord.

The base fixture may comprise a base plate, a cover and hinge means for hingedly attaching the cover to the base plate. The input lead-retaining means may comprise a base plate component for retaining associated first and third sections of the input lead in abutting contact with a detonating cord extending through the pass-through aperture and in mutual generally parallel relation. There may also be a cover component for retaining an associated second section of the input lead in crosswise relation to sections associated with the base plate component and in abutting contact with such detonating cord. In a preferred embodiment, the third section of the input lead may have one end secured in the detonator, i.e., the input lead may comprise an eyelet lead.

The invention also has several method aspects, relating to methods for disposing a detonator in enhanced signal transfer configuration with a detonating cord. One method pertains to an input lead comprising at least one strand input line. The method comprises disposing the input lead in multiple abutting contact with the detonating cord. There is also a method pertaining to an input lead comprising at least two input lines, the method comprising disposing each of the at least two input lines in abutting contact with the detonating cord.

The invention also relates generally to a method for configuring the input lead of a detonator in signal transfer relation with a detonating cord using a slider unit comprising a base fixture having a pass-through aperture for receiving a detonating cord therein. The method comprises engaging the input lead on the base fixture in a configuration which will establish enhanced signal transfer configuration with such a detonating cord extending through the pass-through aperture.

According to one aspect of the invention, the method may comprise engaging the input lead on the base fixture in position to provide at least partial wrap-around contact with such a detonating cord. Alternatively, the method may comprise engaging the input lead on the base fixture in position to provide at least two points of abutting contact with such a detonating cord. If the input lead comprises at least two input lines, the method may further comprise disposing at least a portion of each of the input lines in generally parallel relation to each other.

The method may be practiced in conjunction with a slider unit in which the base fixture comprises a base plate, a cover and hinge means for hingedly attaching the cover to the base plate, the cover being movable between an open position and a closed position relative to the base plate. The base plate and the cover each define respective apertures that cooperate when the cover is in the closed position to define a pass-through aperture for the base fixture. The input lead-retaining means may comprise a first component on the base plate and a second component on the cover. The method may then comprise disposing the cover in an open position, engaging a first portion of the input lead with the first component of the input lead-retaining means and engaging a second portion of the input lead with the second component of the input lead-retaining means. The method then comprises closing the cover onto the base plate to retain the input lead in the base fixture with the first portion and the second portion in abutting contact with a detonating cord extending through the pass-through aperture. Closing the cover may dispose the second portion of the input lead in crosswise relation to the first portion.

The method may be employed with an input lead comprising an eyelet lead having two ends secured in the detonator. The eyelet lead comprises a first portion comprising first and second input lines, each input line comprising a signal-emitting end secured in the detonator, the input lead further comprising a bight portion between the first and second input lines. The method may then comprise engaging the first and second input lines with the first component of the input lead-retaining means to dispose the first and second input lines in position to provide abutting contact with such a detonating cord extending through the pass-through aperture and in generally parallel mutual relation to each other. The bight portion of the shock tube segment may then be engaged with the second component of the input lead-retaining means, and the cover may then be closed to dispose the bight portion in crosswise relation to the first and second input lines and in abutting contact with such a detonating cord.

As used herein and in the claims, the term "input line" as used in relation to a detonator refers to a length of signal transmission line that has an end secured in the detonator, for carrying an initiation signal to the detonator.

The term "strand" as used in relation to a detonator input line indicates an input line having two ends with only one end secured in the detonator.

The terms "looped input line segment" and "eyelet lead" refer to a segment of signal transmission line having two ends, both of which are secured in the detonator. A looped input line segment thus provides two input lines for the detonator.

The term "input lead" refers collectively to all the input lines of a detonator.

BRIEF DESCRIPTION OF THE DRAWINGS

The description of the invention will be understood with reference to the following Figures, in which corresponding structures are assigned equivalent identifying numerals:

FIG. 6A is a plan view of the base fixture of a slider unit in accordance with another embodiment of the present invention, together with a detonator as shown in FIG. 1 with the input lead disposed in the input lead-retaining means of the base plate and the cover;

FIG. 6B is a view of the base fixture of FIG. 6A showing how the input lead is configured when the cover is closed, the cover being omitted for clarity;

FIG. 7 is a view similar to FIG. 6A, but with a detonator having an input lead comprising two input lines;

FIG. 8A is a view similar to FIG. 7, but with a detonator having an input lead comprising a looped segment of shock tube disposed in the input lead-retaining means of both the base plate and the cover;

FIG. 8B is a view similar to FIG. 8A showing the configuration of the input lead when the cover is in the closed position, the cover being omitted for clarity;

FIG. 8C is a view corresponding to FIG. 8B showing another embodiment of the input lead;

DETAILED DESCRIPTION OF THE INVENTION AND PREFERRED EMBODIMENTS THEREOF

The present invention relates to a method and apparatus for the transfer of a blasting initiation signal from a detonating cord downline to the input lead of a detonator for a booster used to initiate borehole blasting agents. The invention relates to configurations for enhanced signal transfer to the detonator that do not require that the input lead be disposed in extended parallel relation to the detonating cord.

Figure 2B:
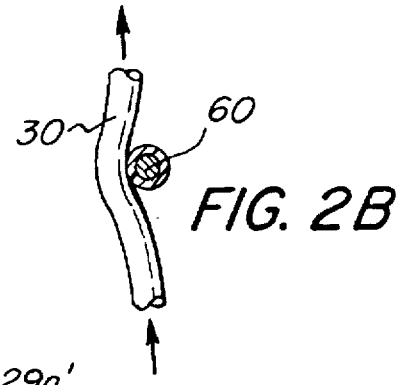
FIG. 2B is a detailed view of an input line disposed in abutting contact with a detonating cord 60.

In accordance with the present invention, one method for obtaining such non-parallel enhanced signal transfer configuration between a detonating cord and a detonator input lead is to dispose the input lead in at least partial wrap-around contact with the detonating cord. The term "wrap-around contact" indicates that the input lead is constrained to assume a curvate configuration having an internal radius designed to dispose the input lead in contact with at least a portion of the cross-sectional circumference of a detonating cord. Another method for attaining enhanced signal transfer configuration is to provide at least two points of abutting contact between the input lead and the detonating cord, e.g., by looping the input lead around so that at least two portions abut the detonating cord, or by placing each of at least two input lines in abutting contact with the detonating cord at least once. The term "abutting contact" indicates contact that results from tangential juxtaposition of the input lead and the detonating cord, optionally with mild lateral force to assure surface contact between them, as illustrated in FIG. 2B. Equally reliable signal transfer is attained with multiple points of abutting or "casual" contact as with a single point of firm contact, the latter resulting from pressure applied in pushing the input lead against the detonating cord to cause the two to deform one or both into substantial surface area contact. While firm contact generally enhances signal transfer reliability as compared to casual contact, even a single point of firm contact can inhibit the detonating cord from sliding through the pass-through aperture and can therefore inhibit proper placement of a booster with which the invention is used. Casual, multiple abutting contact thus provides equally reliable signal transfer and better slidability than firm contact.

The method and apparatus of the present invention improve the reliability of signal transfer between the detonating cord and the input lead by increasing the available region of signal transfer between a downline and a detonator input lead. The invention also relates to devices that are useful in establishing enhanced signal transfer configuration between a detonator input lead and a downline detonating cord.

Figure 1:
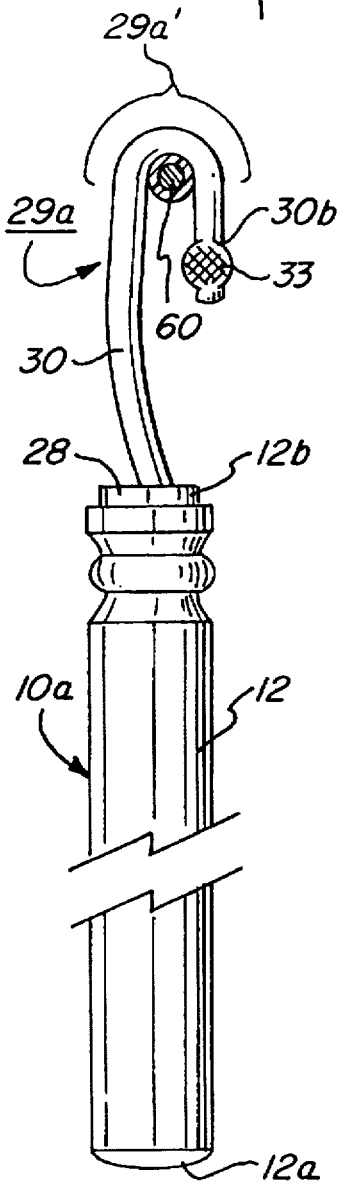
FIG. 1 is an elevation view of a detonator having an input lead in partial wrap-around contact with a detonating cord in accordance with one embodiment of the present invention.

One type of detonator that can be employed in connection with the present invention is illustrated in FIG. 1. In detonator 10*a*, input lead 29*a* comprises a single signal transmission input line 30 which comprises a strand of shock tube having two ends. One end of the shock tube strand is a signal-emitting end disposed in signal transfer relation to a target charge (not shown) within detonator 10*a*. The target charge comprises at least an explosive output charge, and optionally other components such as a receptor charge and a pyrotechnic or digital delay unit, as is well-known in the art, so that detonator 10*a* may be either a conventional delay or an "instant" (i.e., non-delay) non-electric detonator, the structure and function of which are well-known to those of ordinary skill in the art. Input line 30 extends outwardly from the input end 12*b* of shell 12 of detonator 10*a* and terminates in distal end 30*b* which is sealed off by seal 33 so that the hollow interior of the shock tube is not exposed to the environment. Since shock tube is conventionally made from thermoplastic polymeric materials, sonic welding or any other suitable method may be used for sealing distal end 30*b*. Input line 30 is in enhanced signal transfer configuration with a signal donor line such as detonating cord 60, shown in cross section, by virtue of the partial wrap-around contact with detonating cord 60. When detonating cord 60 of FIG. 1 initiates, a signal is transferred to the shock tube input line 30. Detonator 10*a* is thereby initiated. The wrap-around contact illustrated in FIG. 1 is only partial wrap-around contact in that the input lead is only in contact with a circumferential arc of about 180 degrees of the center of the detonating cord. It will be appreciated however, that the input lead could be fully wrapped around the detonating cord in accordance with the present invention, if desired, provided that the wrap is sufficiently loose that it does not prevent the input lead from sliding along the detonating cord.

Figure 2A:
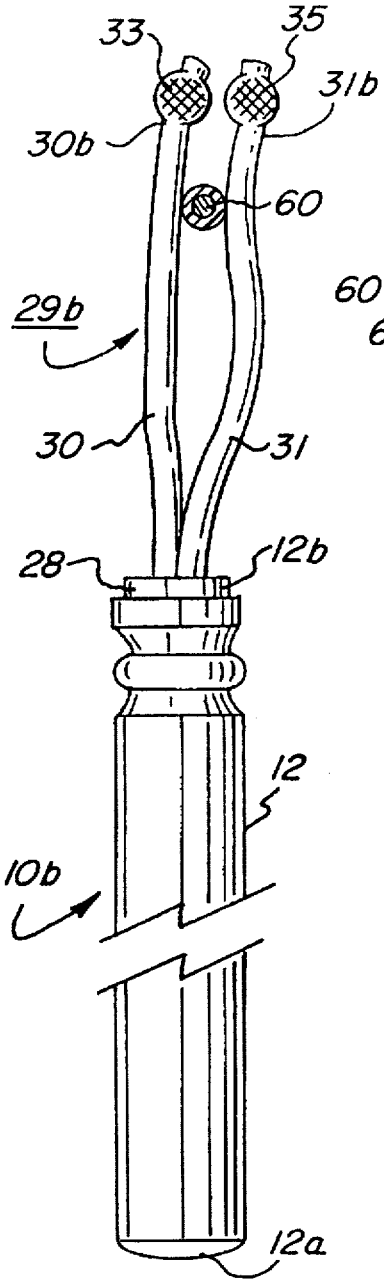
FIG. 2A is a view similar to that of FIG. 1 of a detonator having an input lead comprising two input lines, each in abutting contact with a detonating cord.

Another embodiment of a detonator useful in the practice of the present invention is shown in FIG. 2A. The detonator 10*b* comprises an input lead 29*b* that comprises two strand input lines 30 and 31, each of which has two ends; a signal-emitting end secured in the input end of detonator 10b and a distal sealed end, i.e., ends 33 and 35. Otherwise, detonator 10b is similar in structure and function to detonator 10a, and corresponding structures are numbered identically. Enhanced signal transfer configuration between detonating cord 60 and input lead 29b is achieved in FIG. 2A by disposing both input lines 30 and 31 in abutting contact with detonating cord 60. Detonating cord 60 can transfer an initiation signal to both input lines so that detonator 10b receives two substantially simultaneous initiation signals to initiate its output charge. If one input line fails to initiate the output charge of detonator 10b, the other input line may succeed. Further, if the detonating cord fails to transfer a signal to one input line, there is a chance that the signal will be successfully transferred to the other input line. Thus, the enhanced signal transfer configuration of FIG. 2A provides, in two ways, added assurance that a signal in the detonating cord will initiate the detonator, compared to a detonator having a single input line in abutting relation to a detonating cord.

Figure 2C:
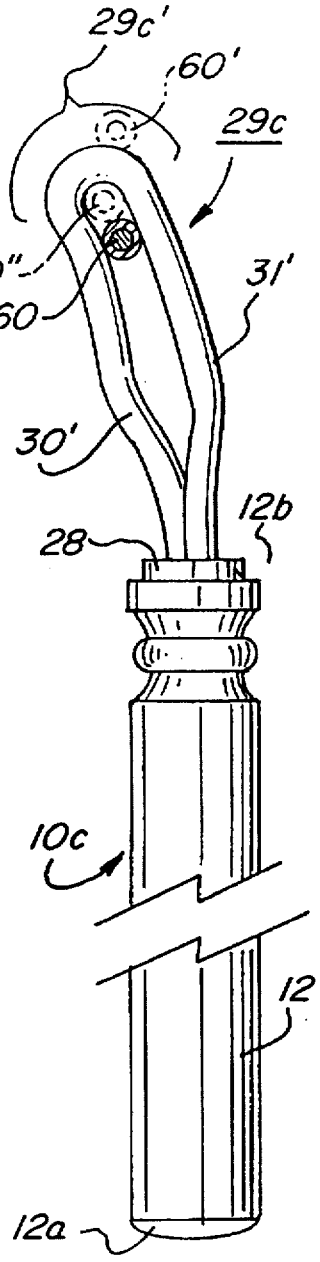
FIG. 2C is an elevation view of a detonator having an input lead comprising an eyelet lead disposed in enhanced signal transfer configuration relation with a detonating cord.

In the embodiment shown in FIG. 2C, input lead 29c of detonator 10c comprises a segment of shock tube bent into a loop to provide a central bight portion 29c' between two opposite signal-emitting ends that are secured in detonator 10c to provide input lines 30' and 31'. As indicated above, such a lead is referred to herein as an "eyelet lead". The donor line, i.e., detonating cord 60, can be passed through the loop defined by eyelet lead 29c and, as illustrated in FIG. 2C, may be disposed in abutting contact with both input lines 30' and 31' so that it has two points of abutting contact with input lead 29c. So disposed, detonating cord 60 can transfer a signal to detonator 10c through either or both input leads 30' and 31', with the same improved reliability of having redundant input lines described above for detonator 10b. However, the looped input lead 29c of detonator 10c provides an advantage even over the two strand input lead 29b because a signal will travel away from each point on lead 29c at which it is received, towards the signal-emitting ends secured in detonator 10c. Detonator 10c will therefore receive two input signals regardless of whether the signal is transferred at both points of abutting contact or at only one. Finally, an eyelet lead can easily be disposed in partial wrap-around relation to the donor line by passing the donor line through the eyelet loop and in engagement with bight portion 29c', as illustrated by detonating cord 60". In such a configuration, the detonator simultaneously derives the benefits of increased surface contact and redundancy of input signals. For these reasons, the eyelet lead embodiment of FIG. 2C is preferred over the multiple strand embodiment of FIG. 2A. Another reason for this preference is that, since both ends of an eyelet lead 29c are secured in the detonator 10c, there is no need for the extra step of sealing the distal ends of the shock tube signal transmission lines, as must be done for the embodiment of FIG. 2A.

The multi-lead detonators of FIGS. 2A and 2C are described more fully in co-pending patent application Ser. No. 08/548,815, filed Jan. 11, 1996 in the name of E. L. Gladden et al., for Detonators Having Multiple-line Input Leads.

Figure 4:
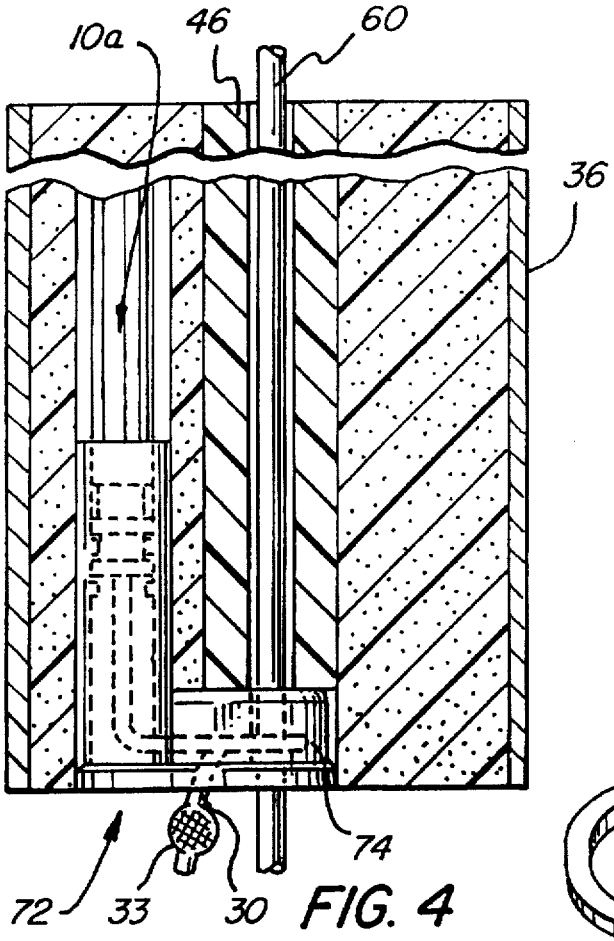
FIG. 4 is a cross-sectional view of a booster equipped with the assembly of FIG. 3A.
Figure 3A:
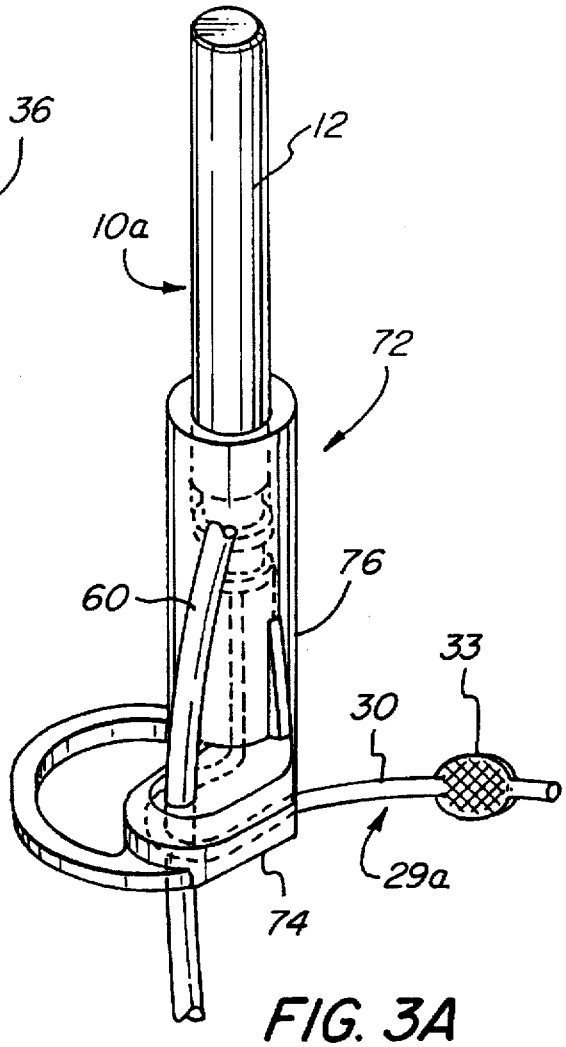
FIG. 3A is a perspective view of a slider unit in accordance with one embodiment of the present invention, together with a detonator and detonating cord disposed therein with the input lead of the detonator in enhanced signal transfer configuration with the detonating cord.
Figure 3B:
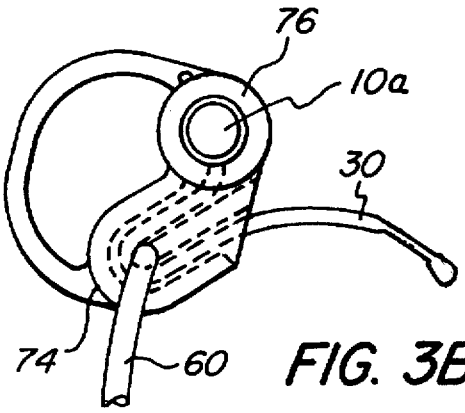
FIG. 3B is a plan view of the assembly of FIG. 3A.

FIG. 3A illustrates an initiator unit comprising a slider unit in accordance with the present invention with a detonator disposed therein. The detonator 10a comprises an input lead comprising a single strand input line 30. Slider unit 72 is designed to provide at least partial wrap-around enhanced signal transfer configuration between the single input line 30 of a detonator 10a and a downline detonating cord 60. Slider unit 72 comprises a base fixture 74 that defines a pass-through aperture (unnumbered) through which detonating cord 60 extends. Slider unit 72 further comprises a detonator retainer that comprises sleeve member 76, which is mounted to base fixture 74. Sleeve member 76 defines an internal bore dimensioned and configured to receive and retain therein the shell 12 of a detonator 10a having an input line 30 projecting therefrom into base fixture 74. Base fixture 74 defines a channel or other input lead-retaining means therein within which at least a portion of the input line may be disposed before a detonating cord 60 is threaded through the pass-through aperture. (As seen in FIGS. 3A, 3B and 4, an extraneous portion of input lead, which may comprise sealed end 33, may project out from the base fixture.) Base fixture 74 may comprise a base plate defining at least a first component of the input lead-retaining means for disposing the input line in partial wrap-around relation to the pass-through aperture. A cover may then be fitted onto the base plate to secure the input line in base fixture 74. Optionally, the cover may be hingedly attached to the base plate. After a detonator is secured in sleeve member 76 with its input lead in base fixture 74, a detonating cord can be disposed in the pass-through aperture. Then, as best seen in FIG. 3B, input line 30 will be disposed in base fixture 74 in approximately a one-half turn wrap-around contact with the detonating cord 60.

Preferably, the input lines comprise lengths of shock tube having an outside diameter (OD) not greater than about 2.380 mm (0.0937 inch), for example, a tube outside diameter (OD) of from about 0.397 to 2.380 mm (about 0.0156 to 0.0937 inch), and the ratio of the inside diameter of the tube to the radial thickness of the tube wall is from about 0.18 to 2.5. The inside diameter of the tube may be from about 0.198 to 1.321 mm (about 0.0078 to 0.0520 inch). The powder surface density of the reactive material contained within the bore of the tube may, but need not, be significantly less than that which the prior art considers to be a minimum acceptable powder surface density. Such shock tube is described in co-pending patent application Ser. No. 08/380,839, filed Jan. 30, 1995, in the name of Ernest L. Gladden et al for "Improved Signal Transmission Fuse".

FIG. 4 shows the environment of use of slider unit 72, detonator 10a and detonating cord 60. Booster 36 is a cast booster that generally comprises a secondary explosive and is cast so that it defines an initiator well within which slider unit 72 and detonator 10a may be received and secured. Booster 36 also defines a central bore within which a hollow shielding sleeve 46 is secured. Shielding sleeve 46 also has a hollow bore dimensioned and configured to receive a detonating cord. Slider unit 72 is dimensioned and configured so that when it is received in the initiator well, the pass-through aperture is aligned with the central bore of the booster. Then, after initiator unit 72 is inserted into the initiator well of booster 36, detonating cord 60 may be threaded through shielding sleeve 46 and the pass-through aperture of base fixture 74. Booster 36 is then slid along detonating cord 62 to the desired position for blasting. Typically, booster 36 is disposed in the borehole filled with a blasting agent such as ammonium nitrate and fuel oil ("ANFO") or the like (not shown). Detonating cord 60 is initiated but it does not initiate booster 36 because of the protective function of shielding sleeve 46. However, detonating cord 60 can transfer an initiation signal to input line 30 and, thus, to detonator 10a. Detonator 10a has sufficient strength to initiate booster 36, which in turn initiates the borehole explosive. Slider unit 72 provides improved reliability in the transfer of an initiation signal from detonating cord 60 to detonator 10c by virtue of the input lead-retaining means in the base fixture that establishes enhanced signal transfer configuration between the two without the need for any apparatus to extend the input lead around the booster. By providing a base fixture that has a pass-through aperture for the downline and input lead-retaining means as described herein, such contact is attained with a shorter input lead than is necessary for use with, e.g., the devices shown in U.S. Re-issue Pat. No. 30,621 (discussed above). Such a configuration also allows for the more economical manufacture of the slider unit since there is no need for external structures needed to join the detonator input lead with a downline that is separated from the booster with which the detonator is used.

Figure 5:
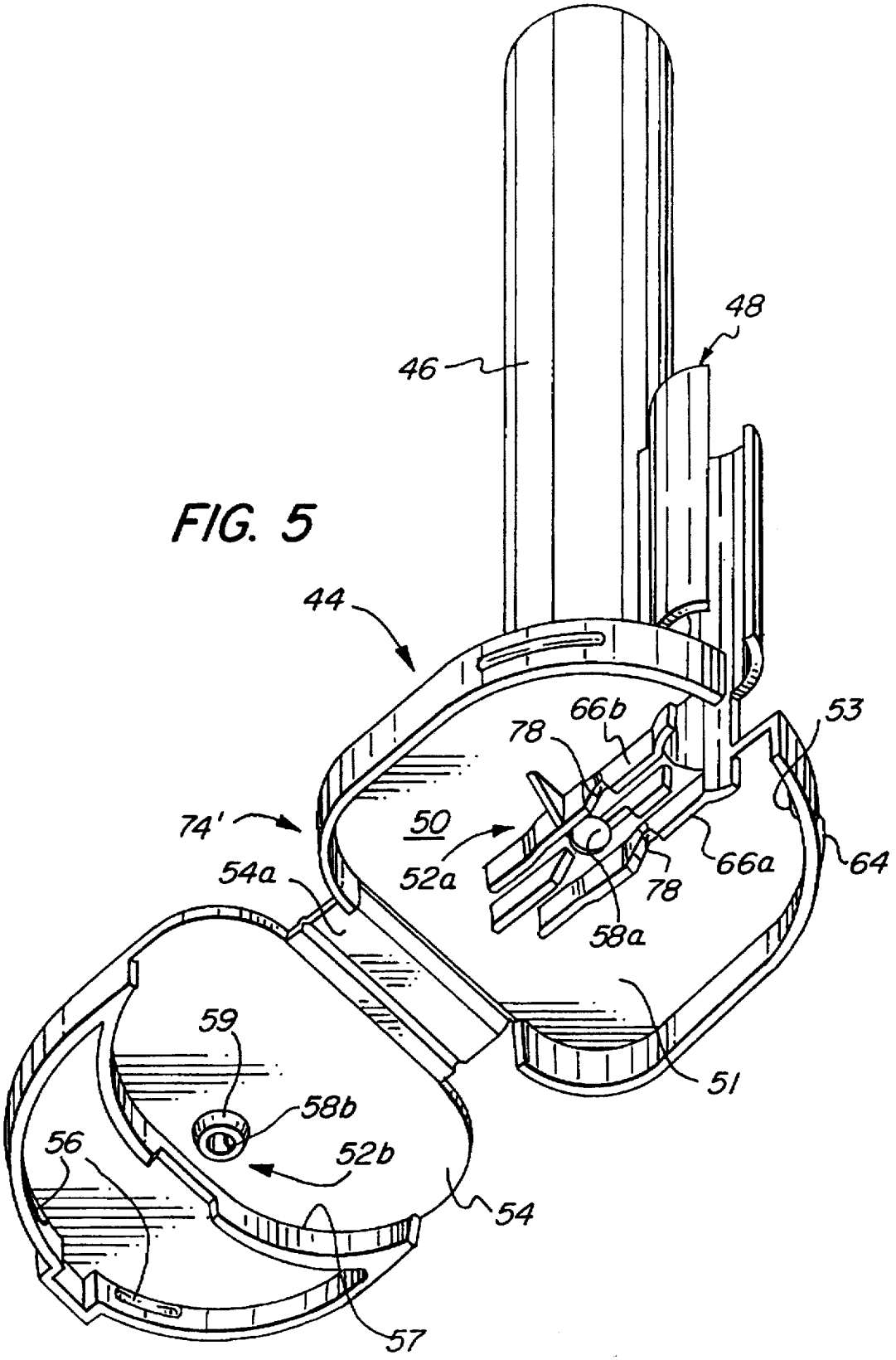
FIG. 5 is a perspective view of a slider unit in accordance with another embodiment of the present invention.

Another slider unit in accordance with the present invention is shown in FIG. 5 which provides an upward-looking perspective view of the bottom of a slider unit 44. Slider unit 44 is useful for holding a detonator in place within a booster in the type of arrangement illustrated in FIG. 4, FIG. 5 being enlarged relative to FIG. 4. Slider unit 44 is adapted for use with a booster of the type which is encased within an outer shell which has means thereon such as recesses located at the bottom of the booster which are engaged by protrusions 64 to mount slider unit 44 and a detonator carried thereon within a booster, as more fully disclosed in commonly owned co-pending patent application Ser. No. 08/575,244 filed on Jan. 16, 1996 in the name of Daniel P. Sutula, Jr., et al for "Slider Member for Booster Explosive Charges".

Figure 9:
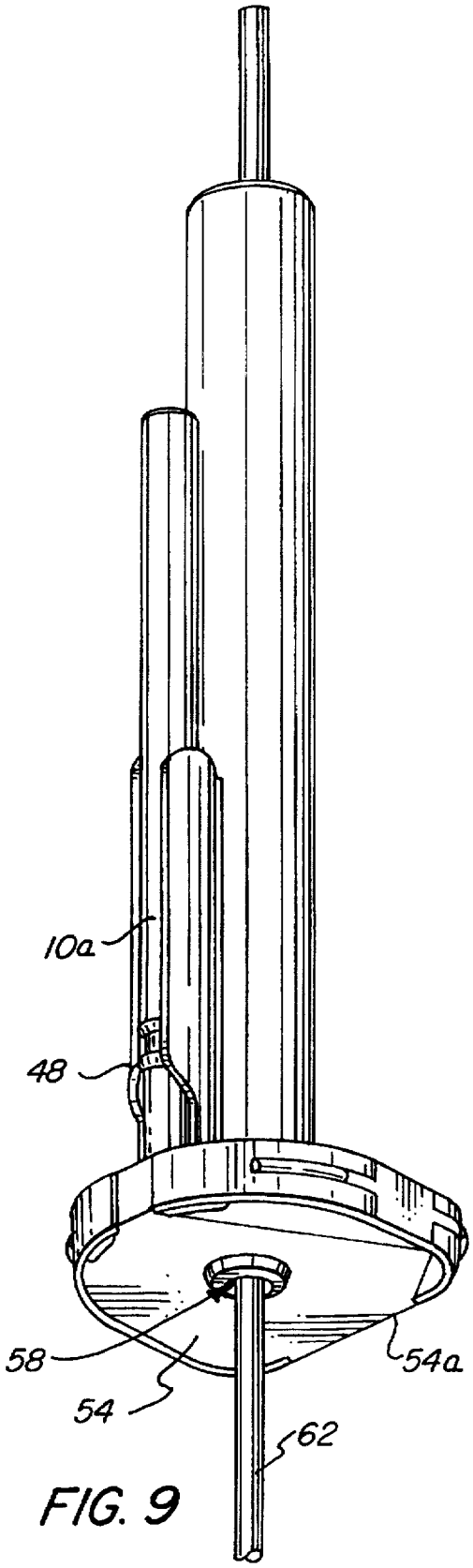
FIG. 9 is a perspective view of the slider unit of FIG. 5 with the cover closed and with a detonating cord extending through the slider unit and the pass-through aperture thereof.
Figure 10:
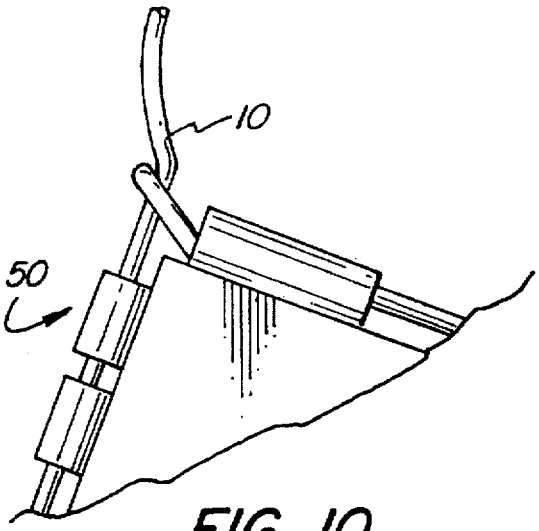
FIG. 10 (PRIOR ART)
FIG. 10 is a partial elevation view of parts of a prior art device.

Slider unit 44 comprises a shielding tube 46 having an internal bore through which the downhole detonating cord passes. Shielding tube 46 not only allows the booster to slide along the detonating cord, but also serves to protect the booster from being damaged or initiated directly from the downline detonating cord, which preferably is a low energy detonating cord. A detonator retainer 48 is carried on shielding tube 46, to hold a detonator such as any one of the detonators illustrated and/or described herein. Slider unit 44 also includes a base fixture 74' that is connected to tube 46. Base fixture 74' comprises a base plate 50, base plate component 52a of the input lead-retaining means, and a cover 54 attached to base plate 50 by a hinge 54a. The base plate component 52a of the input lead-retaining means comprises flanges 66a, 66b that define saddle recesses 78, the function of which will be described below. Cover 54 optionally carries a cover component 52b of the input lead-retaining means which comprises, in the illustrated embodiment, flange 57 and the grommet or raised annular boss 59 that encircles aperture 58b. FIG. 5 shows hinged cover 54 in the open position; the cover may be closed as shown in FIG. 9 by swinging cover 54 about hinge 54a whereby cover 54 and base plate 50 cooperate to define an enclosed base chamber 51 (indicated in FIG. 5) within which the signal-receiving portion of the input lead of the detonator is disposed. Base plate 50 and cover 54 define base plate aperture 58a and cover aperture 58b respectively. These apertures align with one another when cover 54 is closed over base plate 50 so that they cooperate to provide a pass-through aperture 58 (FIGS. 8B, 8C and 9) that allows a detonating cord 62 to pass through the base fixture. Base plate 50 (FIG. 5) comprises cover-engaging detents, only one of which, detent 53, is seen in FIG. 5. Cover 54 comprises detent-receiving slots 56 that engage corresponding detents 53 when cover 54 is closed onto base plate 50 and that keep cover 54 in the closed position. Within the base chamber 51, the base plate component 52a and the cover component 52b of the input lead-retaining means cooperate to keep the input lead of a detonator in enhanced signal transfer configuration relation with the pass-through aperture, e.g., in position to assume casual, abutting contact with a detonating cord in the pass-through aperture, as will be described more fully below.

Figure 5A:
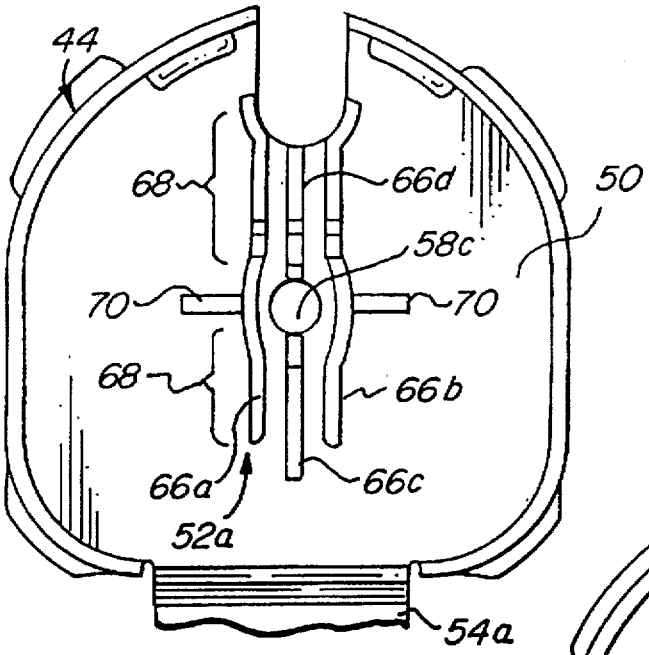
FIG. 5A is a plan view of the base plate of the slider unit of FIG. 5.

As seen in FIG. 5A, the base plate component 52a of the input lead-retaining means comprises flanges 66a, 66b, 66c and 66d which are dimensioned and configured to define retaining channels to position a first portion of an input lead from a detonator in abutting contact relation with aperture 58a. On opposite sides of aperture 58a, flanges 66a and 66b define "pinch" regions 68 where a pair of input lines are disposed too close to one another to allow a typical detonating cord to pass between them. Between the pinch regions 68, flanges 66a and 66b diverge slightly around aperture 58a to permit input lines therein to bend around a detonating cord or other downline passed through aperture 58a, as discussed more fully below. Flanges 66a, 66b, 66c and 66d are dimensioned and configured to receive and retain an input lead therein so that a user can easily but securely engage the input lead with the input lead-retaining means.

Figure 5B:
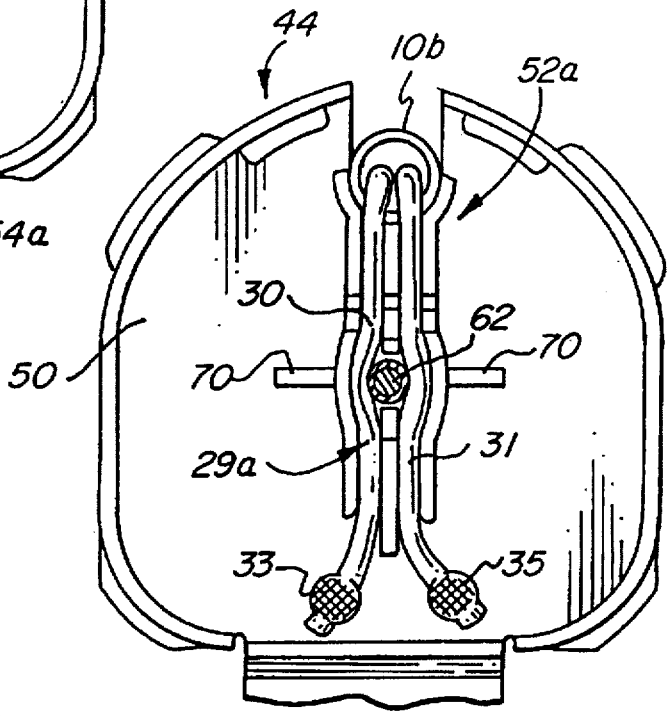
FIG. 5B is a view similar to FIG. 5A showing the input lead of a detonator in the input lead-retaining means on the base plate to dispose the input lead in abutting contact with a detonating cord.

As seen in FIG. 5B, when the detonator 10b is disposed in place in the slider unit to provide an initiator unit, input lines 30 and 31 are disposed in the base plate component 52a of the input lead-retaining means. Pinch regions 68 and the flared region therebetween constrain lines 30 and 31 to closely bend around a detonating cord 62 that extends through aperture 58a (FIG. 5A), i.e., input lines 30 and 31 are each disposed in casual, abutting contact with detonating cord 62, at points even with gussets 70. As a result, there are two points of abutting contact between the detonating cord 62 and the input lead 29a, and each of these can serve as points where an initiation signal is transmitted from detonating cord 62 to the detonator. This redundancy in signal transfer capability increases the reliability with which a signal can be transferred from cord 62 to the detonator.

Preferably, flanges 66a, 66b do not bear on lines 30, 31 in the deflection region even when lines 30, 31 are deflected about a detonating cord, i.e., they are disposed at a slight stand-off from the input lines in the deflection region to avoid imposing firm contact between the input lines and the detonating cord due to foreseeable variations in the diameters of the input lines and the detonating cord. The inherent resilience of the input lines and the slight stand-off of flanges 66a, 66b allows them to engage in casual abutting contact with the detonating cord in the deflection region. However, flanges 66a, 66b are configured to constrain lines 30, 31 from deflecting away from the detonating cord to a significant degree when the detonating cord initiates, since this could result in a failure to transfer the initiation signal to the input line. Gussetts 70 reinforce flanges 66a, 66b against the lateral force of initiation of the detonating cord and thus enhance the reliability of signal transfer to the input lead.

Figure 5C:
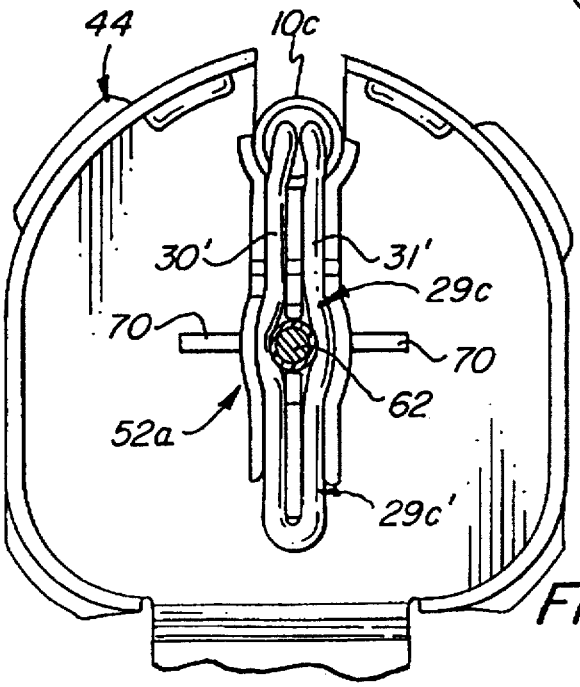
FIG. 5C is a view similar to FIG. 5B except that the input lead for the detonator comprises a looped shock tube segment disposed in partial wrap-around contact with the detonating cord.

FIG. 5C shows detonator 10c of FIG. 2C mounted within slider unit 44 with input lines 30' and 31' both in abutting contact with detonating cord 62.

As illustrated in FIGS. 6A and 6B, a slider unit as generally described in connection with FIGS. 5 and 5A can be used in the practice of the present invention with a detonator whose input lead comprises a single input line. Slider unit 44' is substantially the same in construction as slider unit 44, except that flanges 66a and 66b of base plate component 52a' of the input lead-retaining means have optional curved ends and that the cover component 52b' of the input lead-retaining means comprises optional stays 61. Detonator 10a is mounted in slider unit 44' and, as seen in FIG. 6A, a first portion 166 of the single strand input line 30 is positioned in the base plate component 52a' of the input lead-retaining means to secure line 30 in abutting contact relation to aperture 58a at a point near gusset 70a. In other words, a first portion of input line 30 is associated with the base plate component 52a' of the input lead-retaining means. A second portion 161 of line 30 is disposed in the cover component 52b' of the input lead-retaining means, i.e., between flange 57 on one side of line 30 and boss 59 and stays 61 on the other side. Together, flange 57, boss 59, and stays 61 cooperate to retain the second portion of line 30 in abutting contact relation with cover aperture 58b. Thus, a second portion of line 30 is associated with the cover component of the input lead-retaining means.

The input lead-retaining means is dimensioned and configured so that when cover 54 is moved into the closed position onto base plate 50, input line 30 is folded over into a configuration in which the second portion 161 of input line 30 is disposed in saddle recess 78. So disposed, second portion 161 is both in abutting contact relation with aperture 58a and in crosswise relation to the first portion 166 of line 30 as shown in FIG. 6B. When a detonating cord extends through pass-through aperture 58 and therefore through base plate aperture 58a, it will come into abutting contact with line 30 at two points, one point being on first portion 166 near gusset 70a and the other points being on second portion 161 at flange 66c. Having two points of abutting contact provides added assurance that the initiation signal from the detonating cord will be transferred to the input lead.

As shown in FIG. 7, a detonator 10b', having two strand input lines 30 and 31 can be disposed in slider unit 44' with each strand mirroring the other in its configuration on base plate 50 and cover 54, which are shown with cover 54 in the open position. When cover 54 is closed onto base plate 50, the respective second portions of the two strands assume the configuration indicated in dotted outline.

A slider unit in accordance with the present invention can also be used in connection with a detonator 10c' having an eyelet lead 29c", as shown in FIG. 8A. A first portion 266 of eyelet lead 29c" comprises input lines 30' and 31' for detonator 10c'. The first portion 266 of eyelet lead 29c" is disposed on base fixture 74' between flanges 66a and 66b of base component 52a' of the line-retaining means, in abutting contact relation with aperture 58a at points near gussets 70a and 70b. A second portion (also referred to as the bight portion) 29c' distally connects input lines 30' and 31' to form the closed loop opposite the detonator. Second portion 29c' is disposed in the cover component 52b' of the line-retaining means, e.g., between flange 57, stays 61 and annular boss 59. When cover 54 is moved about hinge 54a into the closed position, eyelet lead 29c" is folded so that it assumes the pretzel-shaped configuration shown in FIG. 8B, in which both input lines 30' and 31' of first portion 266 are disposed in abutting contact relation with pass-through aperture 58 and the second portion, i.e., bight portion, 29c', is positioned to attain abutting contact with a detonating cord extending through base plate aperture 58a at a point on bight portion 29c' at flange 66c. Bight portion 29c' is also in crosswise relation to input lines 30' and 31' of the first portion 266. So configured, eyelet lead 29c" can be described as having a first section (which comprises input lead 30' of first portion 266) having one end secured in the detonator and being disposed in position for abutting contact with a detonating cord extending through the pass-through aperture. A second section of input lead 29c" comprising bight portion 29c' forms a first loop and passes transversely over and beyond the first section to provide a second point of abutting contact with a detonating cord that extends through the pass-through aperture. Finally, a third section comprising input lead 31' forms a second loop and which passes transversely to and beyond the second section to a third point of abutting contact with such a detonating cord. In an optional alternate embodiment, a single input line 30" can be disposed in a pretzel-like configuration similar to that shown in FIG. 8B, except that the end of the third section 131 is sealed at 33 rather than being secured in the detonator cap, as shown in FIG. 8C.

When cover 54 is swung into the closed position to enclose the input lead of a detonator disposed therein, a downline detonating cord 62 can be received in and will extend through the pass-through aperture 58, as shown in FIG. 9. The detonating cord so disposed will be in enhanced signal transfer configuration with the input lead of the detonator secured on the detonator retainer. By disposing the input lead in a base fixture through which the downline passes, the sliders of the present invention provide assurance that an input lead therein cannot catch on a downline sliding therethrough.

Preferably, a detonating cord extending through the booster charge has, in cross section, a major flattened peripheral arc from which the signal output from the cord is more effectively transferred than at other peripheral regions. For example, the detonating cord may have an oval cross-sectional configuration having a major cross-sectional axis and a minor cross-sectional axis, and the major flattened peripheral arc extends along the major cross-sectional axis. Preferably, the input lead of the detonator is disposed in contact with the major flattened peripheral arc of the detonating cord. Optionally, the input lead may comprise an input line having, in cross section, a major flattened peripheral arc for increased sensitivity to the detonating cord signal, and the major flattened peripheral arc of the detonating cord is in contact with the major flattened peripheral arc of the input lead. The slider member may be configured to facilitate such contact. For example, the pass-through aperture 58 of the base fixture 74 may be oval to conform to the detonating cord and bias the detonating cord into a particular orientation, and the lead-retaining means may be configured to dispose the input lead so that it contacts the major flattened peripheral arc of the detonating cord, preferably with its own major flattened peripheral arc.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A slider device for positioning in a booster a detonator having an input lead and for disposing the detonator in signal transfer relation with a downline detonating cord, the slider device comprising:

a base fixture having a pass-through aperture for receiving and retaining the downline detonating cord therein; and input lead-retaining means carried on the device for disposing such input lead of such detonator in position for at least partial wrap-around contact with such detonating cord extending through the pass-through aperture.

2. A slider device for positioning in a booster a detonator having an input lead and for disposing the detonator in signal transfer relation with a downline detonating cord, the slider device comprising:

a base fixture having a pass-through aperture for receiving and retaining the downline detonating cord therein; and input lead-retaining means carried on the device for disposing such input lead of such detonator in position for multiple abutting contact with such detonating cord extending through the pass-through aperture.

3. The slider device of claim 1 or claim 2 further comprising a detonator retaining means on the device for receiving and retaining such detonator therein.

4. The slider device of claim 1 or claim 2 wherein the base fixture comprises a base plate, a cover and hinge means for hingedly joining the cover to the base plate for movement of the cover from an open position in which the input lead-retaining means is exposed to permit manipulation of such input lead into engagement with the input lead-retaining means to a closed position, the base plate and cover cooperating when the cover is in its closed position to define a base chamber within which the input lead-retaining means is located.

5. The slider device of claim 4 wherein the input lead-retaining means comprises a first component carried on the base plate and a second component carried on the cover.

6. The slider device of claim 5 wherein the second component of the input lead-retaining means is dimensioned and configured to dispose a first portion of such input lead in transverse relation to a second portion of the input lead engaged by the first component of the input lead-retaining means.

7. An initiator unit comprising the slider device of claim 1 or claim 2 in combination with a detonator comprising an input lead, the input lead being disposed in the input lead-retaining means to position the input lead for enhanced signal transfer configuration with a detonating cord that may extend through the pass-through aperture of the slider device.

8. The initiator unit of claim 7 wherein the input lead comprises at least one strand of input line.

9. The initiator unit of claim 7 wherein the input lead comprises at least one eyelet lead having a middle portion and two end portions, each end portion providing an input line for the detonator, wherein the input lead-retaining means positions the eyelet lead to provide abutting contact with such detonating cord.

10. The initiator unit of claim 7 wherein the input lead comprises at least one eyelet lead having a middle portion and two end portions, each end portion providing an input line for the detonator, wherein the input lead-retaining means disposes the eyelet lead so that such detonating cord will pass through the eyelet lead.

11. The initiator unit of claim 7 wherein the input lead comprises at least two input lines, wherein the input lead-retaining means on the base plate disposes first portions of the input lines in generally parallel relation to each other to provide abutting contact with such detonating cord.

12. The initiator unit of claim 11 wherein the input lead-retaining means disposes second portions of the input lines in abutting contact with such detonating cord and in crosswise relation to the first portions.

13. The initiator unit of claim 7 wherein the input lead-retaining means is dimensioned and configured to dispose consecutive sections of an input lead as follows: (i) a first section having one end secured in the detonator is disposed to provide a first point of abutting contact with such detonating cord, (ii) a second section which forms a first loop and which passes transversely over and beyond the first section to provide a second point of abutting contact with such detonating cord, and (iii) a third section which forms a second loop and which passes transversely to and beyond the second section to provide a third point of abutting contact with such detonating cord.

14. The initiator unit of claim 13 wherein the base fixture comprises a base plate, a cover and hinge means for hingedly joining the cover to the base plate, and wherein the input lead-retaining means comprises a base plate component for retaining associated first and third sections of the input lead in abutting contact with such detonating cord and in mutual generally parallel relation, and a cover component for retaining an associated second section of the input lead in crosswise relation to portions associated with the base plate component and in position to provide abutting contact with such detonating cord.

15. The initiator unit of claim 14 wherein the input lead comprises an eyelet lead wherein the third section of the input lead has one end secured in the detonator.

16. A method for disposing a detonator having an input lead comprising at least two input lines in signal transfer relation to a detonating cord, the method comprising disposing each of the at least two input lines in abutting contact with the detonating cord, wherein the input lead comprises an eyelet lead.

17. A method for configuring the input lead of a detonator in signal transfer relation to a detonating cord for transferring an initiation signal to the detonator, the detonator being retained within a slider unit comprising a base fixture having a pass-through aperture for receiving a detonating cord therein, the method comprising engaging the input lead on the base fixture in position to provide at least partial wrap-around contact between the input lead and such detonating cord.

18. A method for configuring the input lead of a detonator in signal transfer relation to a detonating cord for transferring an initiation signal to the detonator, the detonator being retained within a slider unit comprising a base fixture having a pass-through aperture for receiving a detonating cord therein, the method comprising engaging the input lead on the base fixture in position to provide at least two points of abutting contact between the input lead and such detonating cord.

19. The method of claim 18 wherein the input lead comprises at least two input lines and wherein the method comprises engaging the input lead on the base fixture in position to dispose at least a portion of each of at least two input leads in position to provide abutting contact with such detonating cord and in generally parallel relation to each other.

20. A method for configuring the input lead of a detonator in signal transfer relation to a detonating cord for transferring an initiation signal to the detonator, the detonator being retained within a slider unit comprising a base fixture having a pass-through aperture for receiving a detonating cord therein, wherein the base fixture comprises a base plate, a cover and hinge means for hingedly joining the cover to the base plate, the cover being movable between an open position and a closed position relative to the base plate, wherein the input lead-retaining means comprises a first component on the base plate and a second component on the cover, the base plate and the cover each defining respective apertures that cooperate when the cover is in the closed position to define a pass-through aperture for the base fixture;

the method comprising disposing the cover in an open position, engaging a first portion of the input lead with the first component of the input lead-retaining means and engaging a second portion of the input lead with the second component of the input lead-retaining means, and then closing the cover onto the base plate to retain the input lead in the base fixture with the first portion and the second portion in abutting contact with such detonating cord.

21. The method of claim 20 wherein closing the cover comprises disposing the second portion of the input lead in crosswise relation to the first portion.

22. The method of claim 20 wherein the input lead comprises an eyelet lead having two ends secured in the detonator, the input lead comprising a first portion comprising a first and a second input line, each input line comprising a signal-emitting end secured in the detonator, the input lead further comprising a second portion comprising a bight section joining the first input line and the second input line, wherein the method comprises engaging the input lines with the first component of the input lead-retaining means to dispose the first and second input lines in position to provide abutting contact with such detonating cord and in generally parallel mutual relation to each other, and engaging the bight portion of the shock tube segment with the second component of the input lead-retaining means, and wherein closing the cover disposes the bight portion in crosswise relation to the first and second input lines and in position to provide abutting contact with such detonating cord.

* * * * *

UNITED STATES PATENT AND TRADEMARK OFFICE

CERTIFICATE OF CORRECTION

PATENT NO. : 5,708,228
DATED : January 13, 1998
INVENTOR(S) : Daniel P. Sutula, Jr. et al It is certified that error appears in the above-indentified patent and that said Letters Patent is hereby corrected as shown below:

In the Abstract, in each of lines 3, 4 and 5, replace "acceptor" with --input--.

In column 11, line 65, replace "input" with --eyelet--.

Signed and Sealed this

Nineteenth Day of May, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,708,228
DATED : January 13, 1998
INVENTOR(S) : Daniel P. Sutula, Jr. et al.

It is certified that error appears in the above-identified patent and that said Letters Patent is hereby corrected as shown below:

Column 13,
Line 52, replace "lines, wherein the" with -- lines, and comprising --; and
Line 53, replace "disposes" with -- for disposing --.

Column 14,
Line 59, replace "wherein the input lead-retaining means comprises" with -- and an input lead-retaining means comprising --.

Signed and Sealed this

Eighteenth Day of March, 2003

JAMES E. ROGAN
*Director of the United States Patent and Trademark Office*